US006393772B1

(12) United States Patent
McRoberts et al.

(10) Patent No.: US 6,393,772 B1
(45) Date of Patent: May 28, 2002

(54) MOVABLE WALL PANEL SYSTEM WITH SELF-PLUMBING PANELS

(75) Inventors: Jerald A. McRoberts; Amy M. Meadows; Melvin W. Tompkins, all of New Castle, IN (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 09/625,635

(22) Filed: Jul. 26, 2000

Related U.S. Application Data

(60) Provisional application No. 60/145,891, filed on Jul. 27, 1999.

(51) Int. Cl.[7] ..... G09F 7/18

(52) U.S. Cl. ..... 52/64; 52/39; 49/409

(58) Field of Search ..... 52/64, 71, 243.1, 52/241, 39; 49/127, 409; 16/87 R, 89; 160/330, 184

(56) References Cited

U.S. PATENT DOCUMENTS 1,176,152 A * 3/1916 Lawrence
1,361,845 A * 12/1920 Frantz
1,689,665 A * 10/1928 Cramp
1,832,050 A * 11/1931 Pitcher
2,337,200 A * 12/1943 Huntley
3,095,830 A * 7/1963 Runken
3,319,584 A * 5/1967 Erickson
4,837,891 A * 6/1989 Toma et al.
4,872,287 A * 10/1989 Block

* cited by examiner

*Primary Examiner*—Blair M. Johnson
(74) *Attorney, Agent, or Firm*—Baker & Daniels

(57) ABSTRACT

A movable wall panel system with panels that automatically plumb to account for slope or rotation of the overhead track. The system includes a cross beam within an interior volume of the wall panel that is connected to at least one trolley movable along the overhead track. The cross beam is pivotally connected to the frame of the wall panel such that the panel can pivot relative to the cross beam, for example within the plane of the panel width. At least one biasing member, such as a compression spring, is located between the frame and the cross beam to resist pivoting motion. In a preferred embodiment, a pendant of each trolley is provided with a pivot surface that engages an underside of the cross beam in weight supporting relationship. The pivot surface and the cross beam underside are complementarily structured and arranged to permit pivoting about the pivot surface of the cross beam and the connected wall panel frame, such as in a direction generally perpendicular to the panel width.

19 Claims, 12 Drawing Sheets

MOVABLE WALL PANEL SYSTEM WITH SELF-PLUMBING PANELS

CROSS-REFERENCE TO RELATED APPLICATION

This application claims the benefit under 35 U.S.C. §119 (e) of U.S. Provisional Application No. 60/145,891, filed Jul. 27, 1999.

FIELD OF THE INVENTION

The present invention pertains to operable walls movable to partition large rooms into smaller rooms, and, in particular, to a system for automatically plumbing operable wall panels.

BACKGROUND OF THE INVENTION

Operable walls or partitions, also known as movable wall panel systems, find useful application in a variety of venues, such as classrooms, offices, convention facilities and hospitals. In these venues, the operable walls can be moved along tracks from which they are suspended to efficiently compartmentalize interior space into a multitude of separate, smaller rooms.

One problem with many existing operable wall panels or partitions is that on occasion the panels have to be plumbed. In particular, the tracks from which the panels are suspended are preferably exactly horizontal. However, in some installations, such as where the structure to which the track is installed is or becomes uneven, the panel track may not be horizontal along the length of the track. Therefore, in order for the panels to be precisely vertical when suspended below the non-horizontal track segment, a plumbing function must be performed.

One existing design which allows automatic panel plumbing provides a pivoting capability whereby a panel outer frame is pivotably connected to an assembly internal to the panel to which typically two trolleys are attached, thereby in practice permitting the panel outer frame to pivot about that connection within the plane of the panel width relative to the track upon which it is mounted. One disadvantage of this type of system is that the current assembly provided within the panel allows too much sway by the panel for some applications. Furthermore, with such a design, and unless stops, such as screws that abut the pivot assembly, are employed as has been done previously, when a person pushes on the bottom of the panel in order to move it between its extended and stacked arrangements, the person may cause the panel corner opposite the corner on which pushing forces are applied to be pivoted into abutting contact with the track, which binds further panel movement.

Another potential problem with movable wall panel systems is that the track may be angularly displaced from vertical at various points along its length. Angularly displaced means that from the perspective of a person looking at a transverse cross-section of the track, the track is rotated within the plane of that transverse cross-section. While certain trolleys and their associated mounting assemblies to which the panel is attached might still function properly with angularly displaced tracks, other trolleys that may have more limited play are less able to accommodate such a displacement.

Thus, it would be desirable to provide a panel plumbing system which overcomes these and other problems of the prior art.

SUMMARY OF THE INVENTION

The present invention provides a movable wall panel system with self-plumbing panels in which the panels are automatically plumbed to account for track unevenness or rotation. In one embodiment, the system allows for panel pivoting that moves the panel relative to its track mounted trolleys, which movement is spring dampened to avoid undesirable motion. In another embodiment, the system allows a panel to be pivoted about a point within its interior volume and in a direction perpendicular to the plane of the panel width to accommodate angular displacement or rotation of the track.

In one form thereof, the present invention provides a self-plumbing movable wall panel system including a wall panel, at least one trolley movable along a track, a pivot element connected to a depending member of the at least one trolley, the pivot element pivotally connected to the frame of the wall panel to allow relative motion therebetween, and at least one biasing member between the frame and the pivot element to resist the relative motion.

In another form thereof, the present invention provides a self-plumbing movable wall panel system including an overhead track, at least one trolley movable along the track, a wall panel, and means for suspending the wall panel from the at least one trolley such that the wall panel is free to pivot within at least one plane about at least one point, wherein the at least one point is located within an interior volume of the panel, and wherein the at least one plane includes a first plane aligned perpendicular to a room wall surface defining width of the panel.

In another form thereof, the present invention provides a self-plumbing movable wall panel system including an overhead track, a wall panel including a frame, a pivot element within an interior volume of the wall panel and including a pivot connection to the wall panel frame to allow the panel to pivot within a first plane relative to the pivot element, and a first trolley and a second trolley each movable along the track. Each of the first and second trolleys includes a depending member vertically extending through openings in a top portion of the panel frame and the pivot element. A distal portion of each of the depending members includes a pivot surface that engages an underside of the pivot element in weight supporting relationship, whereby movement of the first and second trolleys along the track moves the wall panel along the track between a wall-forming position and a storage position. The pivot surface and the pivot element underside are complementarily structured and arranged to permit pivoting about the pivot surface of the pivot element and the connected wall panel frame in a direction generally perpendicular to the first plane. The system also includes first and second biasing members between the frame and the pivot element to resist pivoting within the first plane of the wall panel relative to the pivot element, wherein the first trolley depending member and the first biasing member are disposed on one side of the pivot connection, and wherein the second trolley depending member and the second biasing member are disposed on the opposite side of the pivot connection.

One advantage of the present invention is that operable wall panels may be self, or automatically, plumbed.

Another advantage of the present invention is that a self-plumbing operable wall panel is provided with springs or other biasing elements to provide resistance to undesired panel swaying that incidentally could occur upon the application of forces during manual pushing of the panel along the track length.

Still another advantage of the present invention is that an operable wall panel is provided that is automatically plumbable both within and perpendicular to the plane of the wall panel width.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
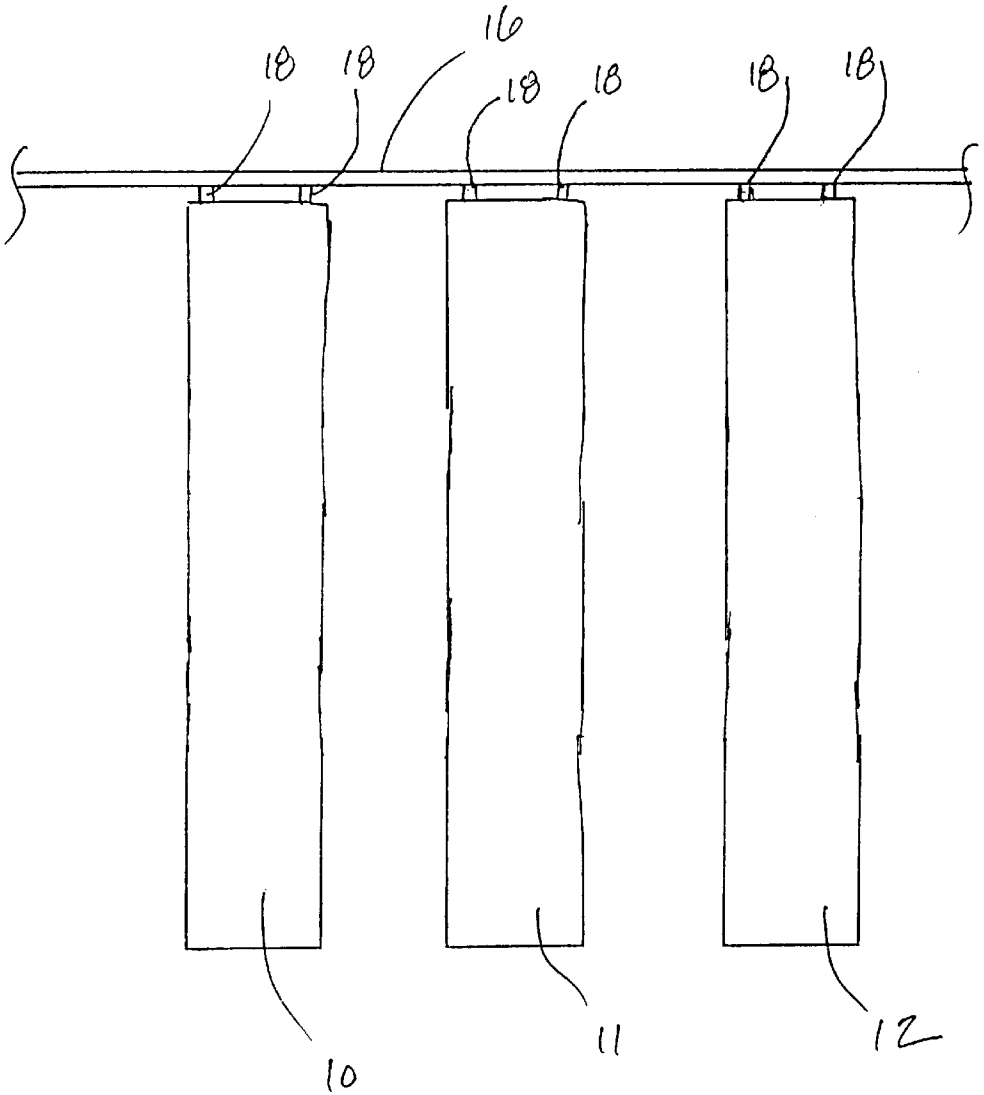
FIG. 1 is a diagrammatic front view of one embodiment of a movable wall panel system with self-plumbing panels of the present invention.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may better utilize the teachings of the invention.

Referring now to FIG. 1, there is diagrammatically shown a movable wall panel system with self-plumbing wall panels of the present invention. The panel system includes operable partitions or wall panels 10, 11 and 12 each suspended from track 16 by a pair of trolleys 18 spaced along the track-aligned width of the panels. Track 16 is mountable in the ceiling of a room to be compartmentalized. The term trolley is used generally herein and is intended to encompass devices, including wheeled carriages and carriers, of all types that are operably connected to and movable along the track. Except for the elements described herein that achieve the panel pivoting capabilities of the present invention, the wall panels may be of any conventional design. None of panels 10–12 are hinged to adjacent panels in the shown embodiment, as the self-plumbing panel system of the present invention is most advantageously utilized in panel systems in which each panel is separately movable along the track, either manually or by a drive system not shown, between an operational, wall-forming position and a storage position.

Figure 2:
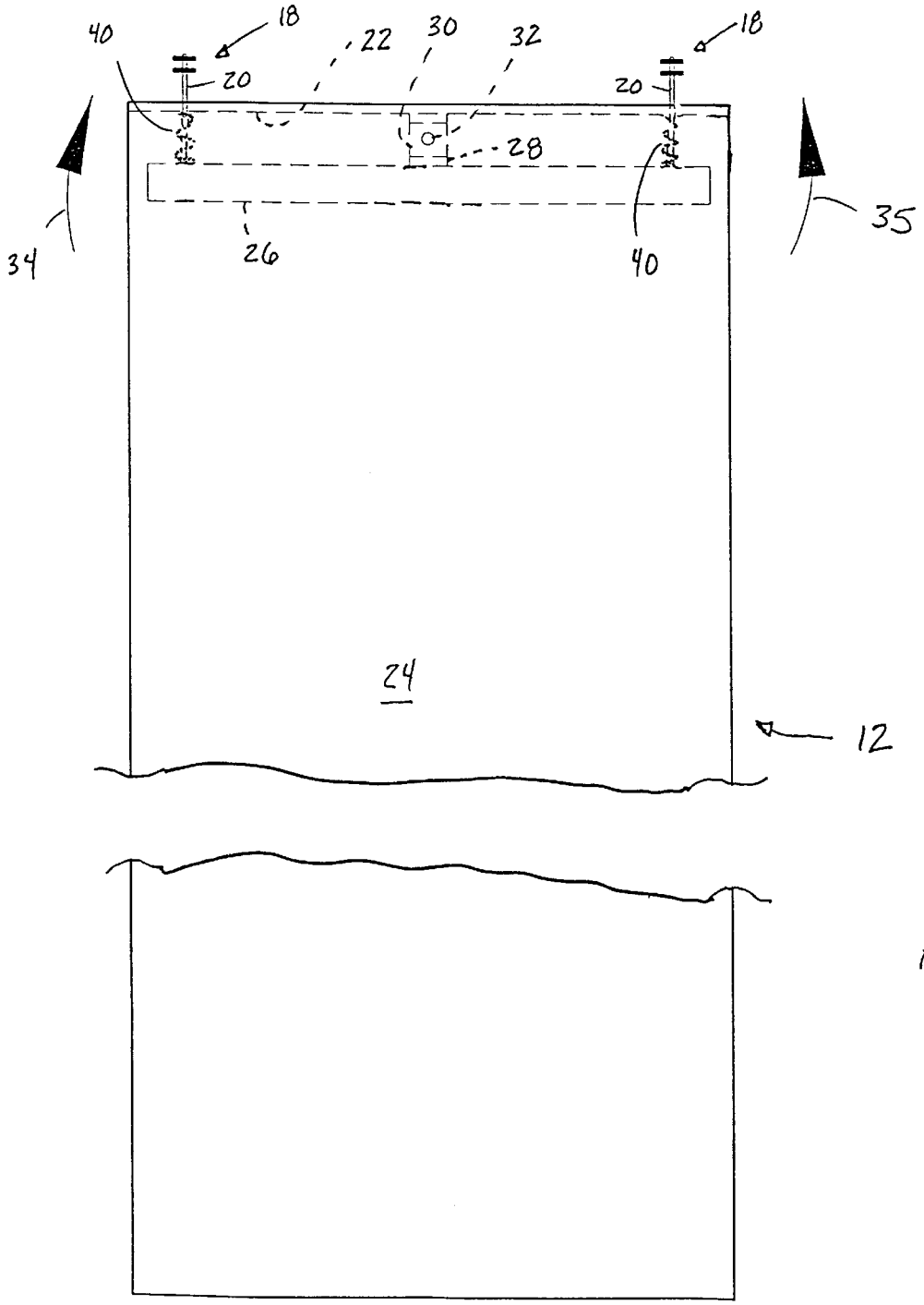
FIG. 2 is a diagrammatic front view of one of the wall panels of FIG. 1 shown removed from the remainder of the operable wall, wherein the components internal to the panel that achieve a self-plumbing of the panel within the plane of the panel are shown in dashed lines.

Referring now to FIG. 2, there is shown a first embodiment of a self-plumbing panel of the present invention. In this embodiment, the panel is designed to self-plumb within a plane in which the panel width is aligned, or in other words within the plane of the sheet on which FIG. 2 is shown. The self-plumbing panel is shown as panel 12 from FIG. 1, but typically all of the panels, such as 10 and 11 as well, of the movable wall panel system will be similarly equipped, and therefore the following description of panel 12 has equal application to the other panels of the movable wall panel system.

The trolley bolts 20 of each of the trolleys 18, shown in FIG. 2 with dual rotating wheels that run within the track, extend downward through openings in the upper steel frame member, indicated abstractly at 22, that generally defines the top surface of panel 12. Other types of trolleys may be used within the scope of the invention. Steel frame member 22 is interconnected with the other panel structural framework members (not shown) and overlaying metal skin 24 which together form the sturdy, parallelepiped shaped periphery of the panel. Steel member 22 may be formed by connecting in a back-to-back arrangement a pair of C-shaped channel members, but the identification of such a configuration is not intended to be limiting as other constructions may be employed within the scope of the present invention.

The threaded lower ends of trolley bolts 20 are secured to a pivot-supporting cross beam 26 disposed within the parallelepiped shaped interior volume of panel 12. Cross beam 26 may be a C-shaped steel channel that is arranged such that its channel opening faces downward. This bolt attachment may be achieved via not shown blocks that are welded to the interior or downward facing surface of beam 26, and which blocks are equipped with tapped bores into which bolts 20 are screwed. Other types of trolley connections may be used within the scope of the invention.

At the center of its length, beam 26 has fixedly secured to and upwardly extending from its top surface a mounting flange 28. Flange 28 is freely received within a space between a flanking pair of pivot supporting plates 30 within the panel interior volume. Plates 30 are fixedly secured to the underside of panel frame member 22. Pivot pin 32 extends through aligned apertures in plates 30 as well as flange 28 to allow flange 28 to pivot relative to plates 30.

This pivoting motion about pin 32 achieves a pivoting of the panel frame and skin relative to the cross beam 26 and therefore track 16 within the plane of the panel width, and in the direction of either of the arrows 34 and 35 shown in FIG. 2.

Disposed between cross beam 26 and frame member 22 within the panel interior volume are springs used to dampen or control the movement of the panel frame relative to the cross beam and track. As shown in FIG. 2, a metal, helical compression spring 40 is located at each end of cross beam 26. The opposite ends of each compression spring 40 abut the underside of frame member 22 and the top surface of cross beam 26. A cylindrical shaft of trolley bolt 20 axially extends through each compression spring 40 in order to allow spring mounting without the aid of additional fastening elements. Springs 40 are selected of a size and of a spring constant in accordance with the weight of the panel to provide a damping effect without excess oscillations during damping, while at the same time allowing the panel weight to produce panel pivoting about pivot pin 32 automatically. In particular, and assuming panel 12 in FIG. 2 is being moved to the right, when the right-most trolley 18 moves up an incline, cross beam 26 also becomes inclined. However, the weight of the panel achieves a pivoting of the panel frame about pivot point 32 relative to cross beam 26, allowing the panel to remain plumb, or in other words the top edge of the panel remains horizontal. The pivoting of the panel frame compresses spring 40 disposed around the left-most trolley 18 between frame 22 and cross beam 26, which compression provides a resisting force that dampens any tendency to over pivot, and further the right-most spring 40 can compress during the pivoting if the panel bounces back too far.

Although two compression springs positioned proximate the cross beam opposite ends are shown, other types of biasing members and positionings may be employed within the scope of the invention. For example, spring-like members made of different materials such as elastomers, as well as different types of springs, could be substituted for compression springs 40. In addition, and in some cases with modifications of the pivoting assembly, fewer or greater number of springs could be used to bias the cross member, and still additional alternate spring types, such as tension springs, could be employed.

Figure 6:
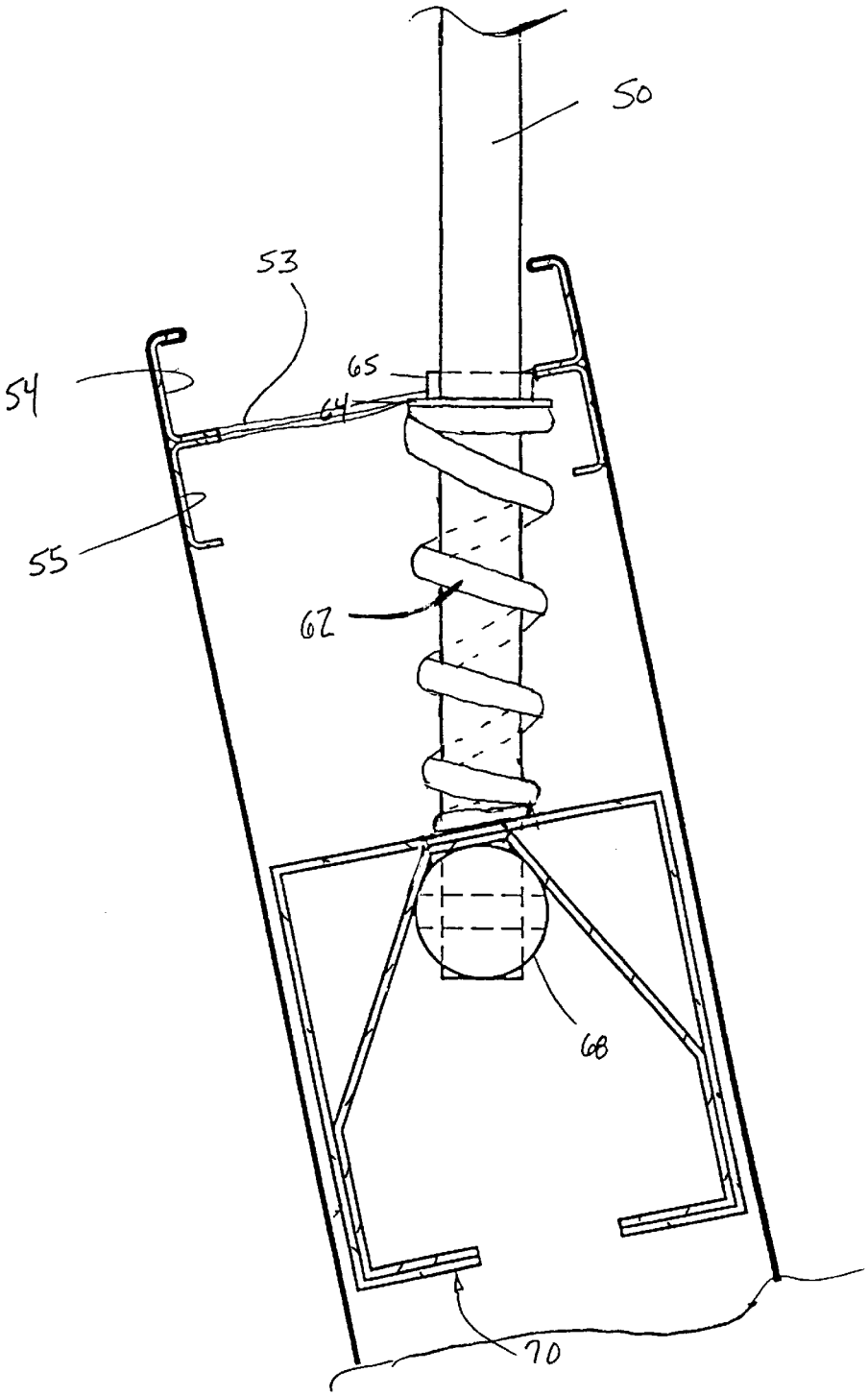
FIG. 6 is a cross-sectional view, similar to the view of FIG. 5, wherein the arrangement of the panel relative to the trolley when the panel pivots in a direction perpendicular to its width is illustrated.

Referring now to FIGS. 3–6, there is shown an alternate embodiment of a self-plumbing panel of the present invention that permits panel pivoting both within and perpendicular to the plane in which its panel width is aligned. This embodiment is more preferred than the embodiment of FIG. 2 due in part to the preferred spring assemblies employed. Bolts 50 from separate trolleys movable in unison along the overhead track extend downward through openings in the upper steel frame assembly of panel 52. The openings, shown at 53 in FIG. 6, are slot-shaped and of a width only slightly larger than the bolt diameter. The upper steel frame assembly is shown formed by rigidly securing together C-shaped channels 54 and 55. Channels 54 and 55 are connected at their opposite ends to the structural frame members 56 and 57 shown abstractly in dashed lines in FIG. 3, and the metal sheets or skins that form the panel surfaces along the panel width are indicated at 59 and 60.

Bolts 50 each extend through the center of a tapered compression spring 62. A washer 64 inserted around the cylindrical, non-threaded shaft of bolt 50 is vertically retained by an abutting pin 65 installed within a cross-bore in each bolt 50. The washer 64 and pin 65 are selectively positioned at a height to provide a preloading of spring 62, the benefits of which are further described below. Washer 64 abuts the upper end of spring 62. The lower end of spring 62 abuts the cross beam, generally designated 70. Washer 64 is sized with a larger diameter than the width of slot shaped opening 53 in the upper steel frame assembly, and consequently engages the underside of frame channel 55 at all angular position of the trolley bolt relative to the height of the panel, such as at the fully angled position shown in FIG. 6. Springs 62 are used to dampen the pivoting of the panel frame relative to the cross beam, as well as to bias the cross beam 70 into engagement with pivot block 68 described below. Other springs, as well as differently positioned springs, may be employed as described above.

The size and location of springs 62, and the amount of preloading applied thereto via the positioning of each pin 65 at a specific height of the trolley bolt 50, is selected by the manufacturer in consideration of factors related to the size and weight of the panel and in order to provide optimal panel operation. In particular, the springs are selected both to be strong enough to provide a resistance to pivoting motion of the panel relative to the track and trolleys, as well as be weak enough to permit the panel to settle under its own weight to a plumbed orientation.

The preloaded springs serve to apply sufficient force to prevent certain pivoting motion that would otherwise, in the absence of the springs, be caused by, for example, the application of force to an edge of the panel by an operator trying to move the panel along the track. The amount of preloading is a function of the weight and center of gravity of the panel, the height and width of the panel, the positioning of the springs relative to the remainder of the pivot-allowing assembly, and the force necessary to move the panel, which force is typically expected or calculated to be applied at about 4.5 to 5 feet above the ground. When force is applied in the direction of the track to a panel side edge, but for the spring interposed between the panel frame and cross beam 70, the panel has a tendency to pivot around the pivot point 94. Consequently, the spring 62 on the trolley bolt 50 positioned between pivot point 94 and the side edge on which the force is being applied by the operator tends to experience a compressive force because it is trapped between cross beam 70 and the pivotable panel frame. The preloaded spring will not further compress until the compressive force applied thereto is equal to its preloading, which preloading force is selected to equal or be slightly greater than the force that results on the spring when the operator applies another force on the side edge in an amount that is equal to such force as is typically required to overcome the frictional forces of the trolley and track when the panel is otherwise not moving. It will be appreciated that if the springs provided are too strong, the pivot system may be too rigid so that the panel will not plumb on its own.

In other words, under normal conditions, the panel will not pivot at all, or perhaps only slightly depending on, for example, manufacturing tolerances, when the operator manually applies such force as is minimally required to start the panel moving along the track. However, the panel will pivot, against the spring resistance, when larger forces or shock loading occurs. It will be appreciated that due to the containment of the spring 62 by the washer and pin on the opposite side of the pivot pin 94, pivoting of the panel does not affect the other spring because its length is captured, and such other spring is not allowed to extend against the panel frame in a manner that would provide an additional force that undesirably tends to promote pivoting motion. However, such other spring may serve to dampen inertia effects by which the panel may pivot back beyond a plumbed orientation.

The threaded lower end of trolley bolt 50 passes through a slot shaped opening in the cross beam 70 and is screwed into a tapped bore transversely provided in the middle of the axial length of a cylindrical, steel pivot block 68. The rounded length portion of pivot block 68 that faces upward serves as the pivot surface for the cross beam 70 as described below, and may be provided in other ways. For example, pivot block 68 could be spherical, or could be provided with a non-rounded or planar downward facing surface while maintaining functionality. In addition, both pivot blocks could be provided as different segments of a common rod. Roll pin 69 held within aligned bores in bolt 50 and pivot block 68 prevents dislodgement of the pivot block 68 from the bolt during use. Other manners of attaching the trolley bolt and pivot block together, such as by welding, may be employed within the scope of the present invention.

Figure 3:
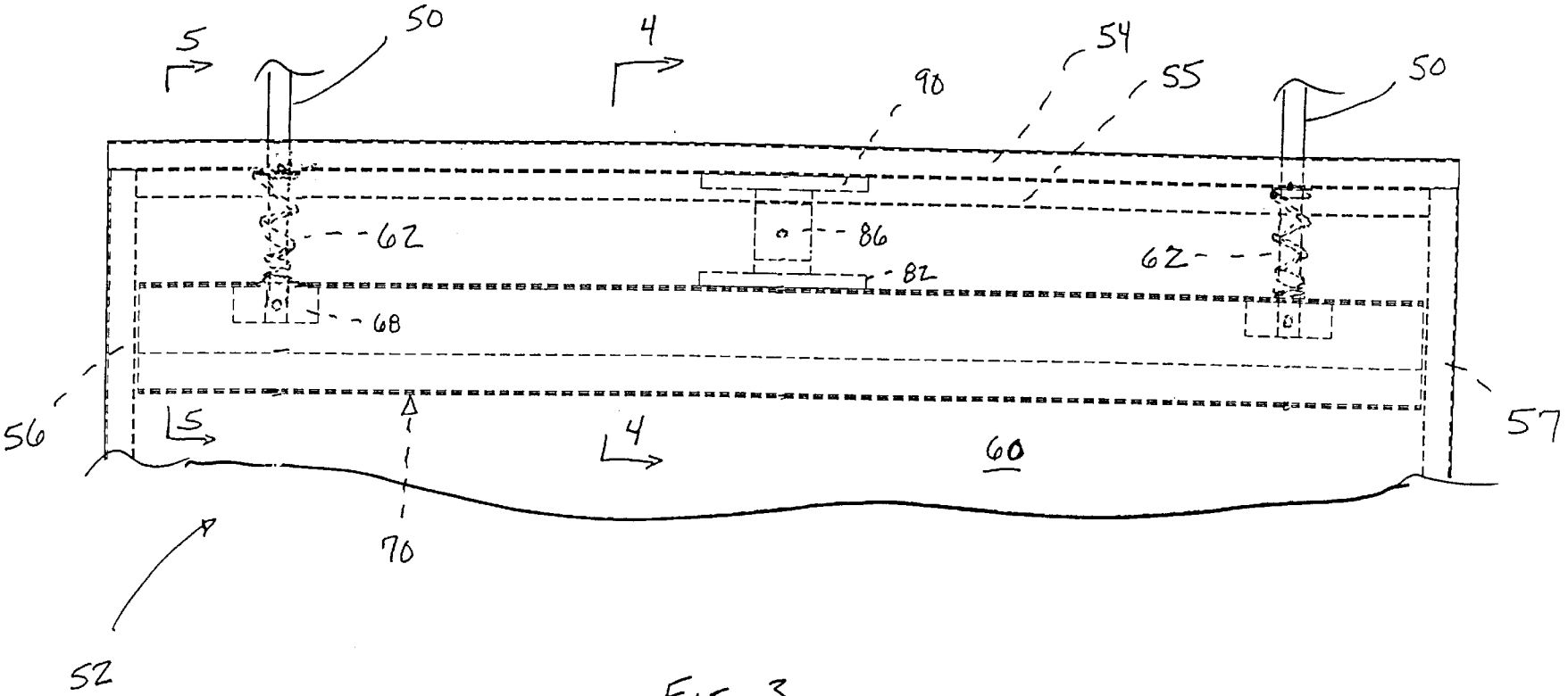
FIG. 3 is a diagrammatic, partial front view of the upper portion of another operable wall panel equipped with an alternate configuration of internal panel components, shown in dashed lines, that achieve a self-plumbing of the panel both within the plane of the panel width and perpendicular to the plane of the panel width.
Figure 4:
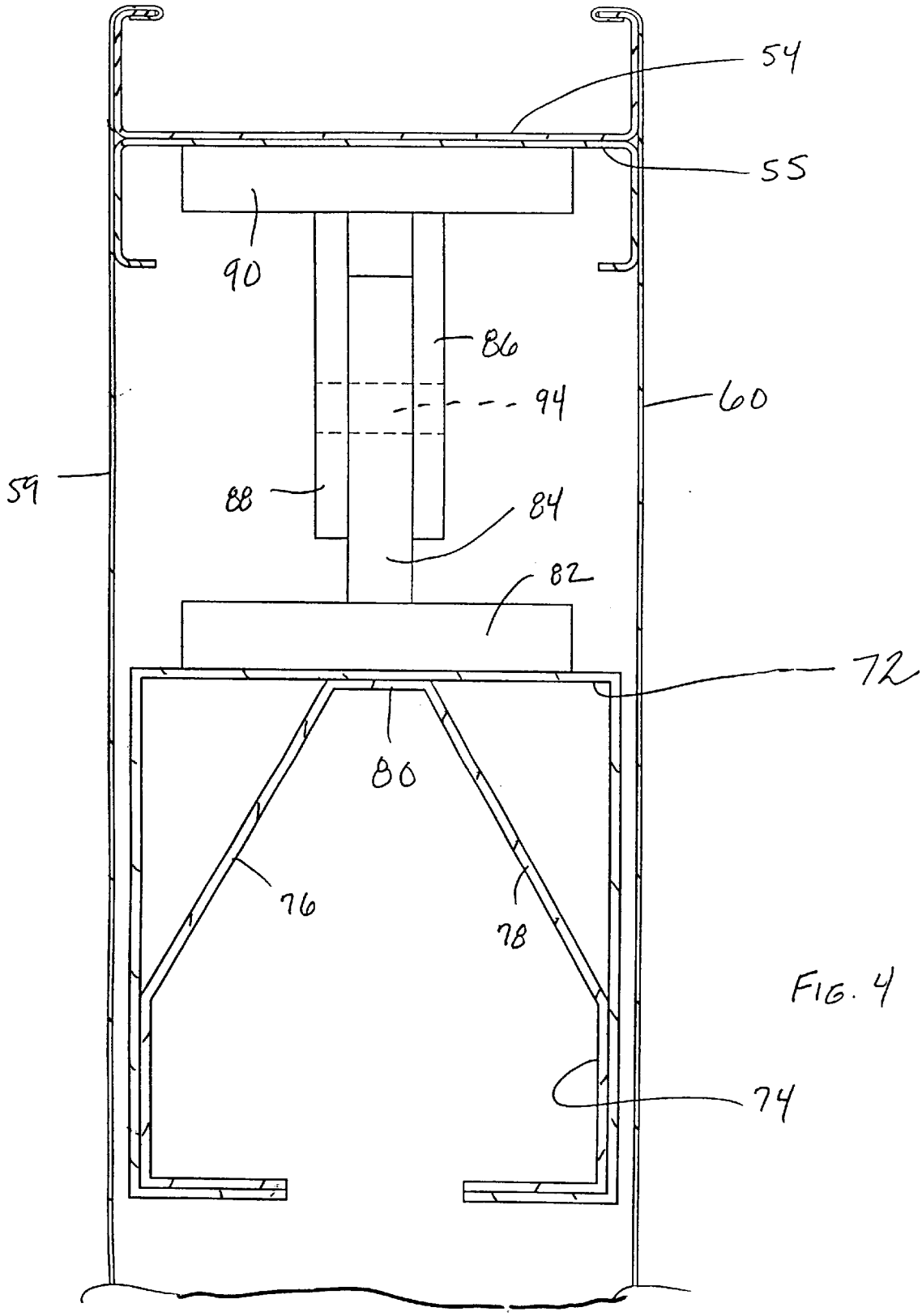
FIG. 4 is a cross-sectional view, conceptually taken along line 4—4 of FIG. 3.
Figure 5:
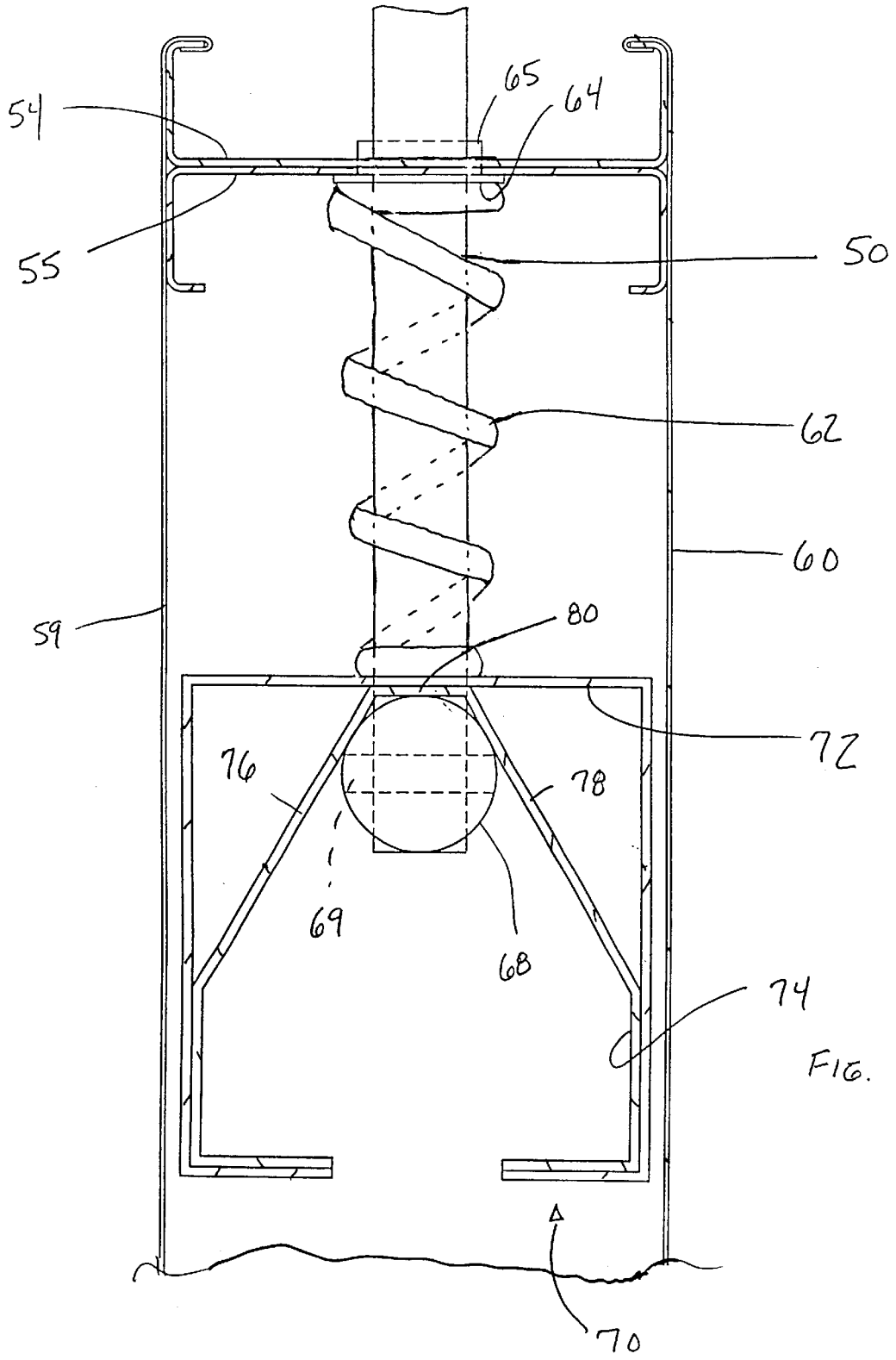
FIG. 5 is a cross-sectional view, conceptually taken along line 5—5 of FIG. 3.

The pivot-supporting cross beam 70 is provided in this embodiment by securing steel outer channel 72 together with steel inner channel 74, each of which extend the entire cross beam length shown in FIG. 3 that substantially spans the panel width. Shorter length cross beams that only span the trolley gap and preferably the pivot block endward extension alternatively may be employed. Inner channel 74 is shaped complementary to the pivot block to facilitate sliding motion therebetween. Inner channel 74 includes slanted, mirror image segments 76 and 78 which are spanned by a horizontal segment 80. The downward facing surfaces of slanted segments 76 and 78 and top segment 80 ride on the rounded periphery of pivot block 68 when the panel is pivoted relative to trolley bolts 50 in a direction generally perpendicular to the plane of the panel width, such as when pivoted in the manner illustrated in FIG. 6. This perpendicular pivotability permits the panel to remain vertical even when the track and trolley bolt 50 is angularly displaced from the vertical orientation shown in FIG. 6, whereat the panel's own weight causes it to so move relative to the trolley bolt.

Cross beam 70 could be fashioned from a single piece of material within the scope of the invention. In addition, the inner channel could be differently configured to achieve a complementary fit with the pivot block, or, provided the outer channel were constructed sufficiently sturdy, dispensed with along the portion of the cross beam not engaged by the pivot blocks 68.

At the center of its length, cross beam 70 has fixedly secured to the top surface of outer channel 74 a mounting plate 82. Fixed to and upwardly extending from plate 82 is a mounting flange 84 that is freely received between pivot supporting plates 86 and 88. Plates 86 and 88 are fixedly secured to the underside of mounting plate 90, which is welded to the underside of frame channel 55. Pivot pin 94 extends through aligned apertures in plates 86 and 88 and mounting flange 84 to permit pivoting of flange 84 relative to plates 86 and 88, which achieves a pivoting of the panel frame and skin relative to the cross beam 70 within the plane of the panel width.

Figure 7:
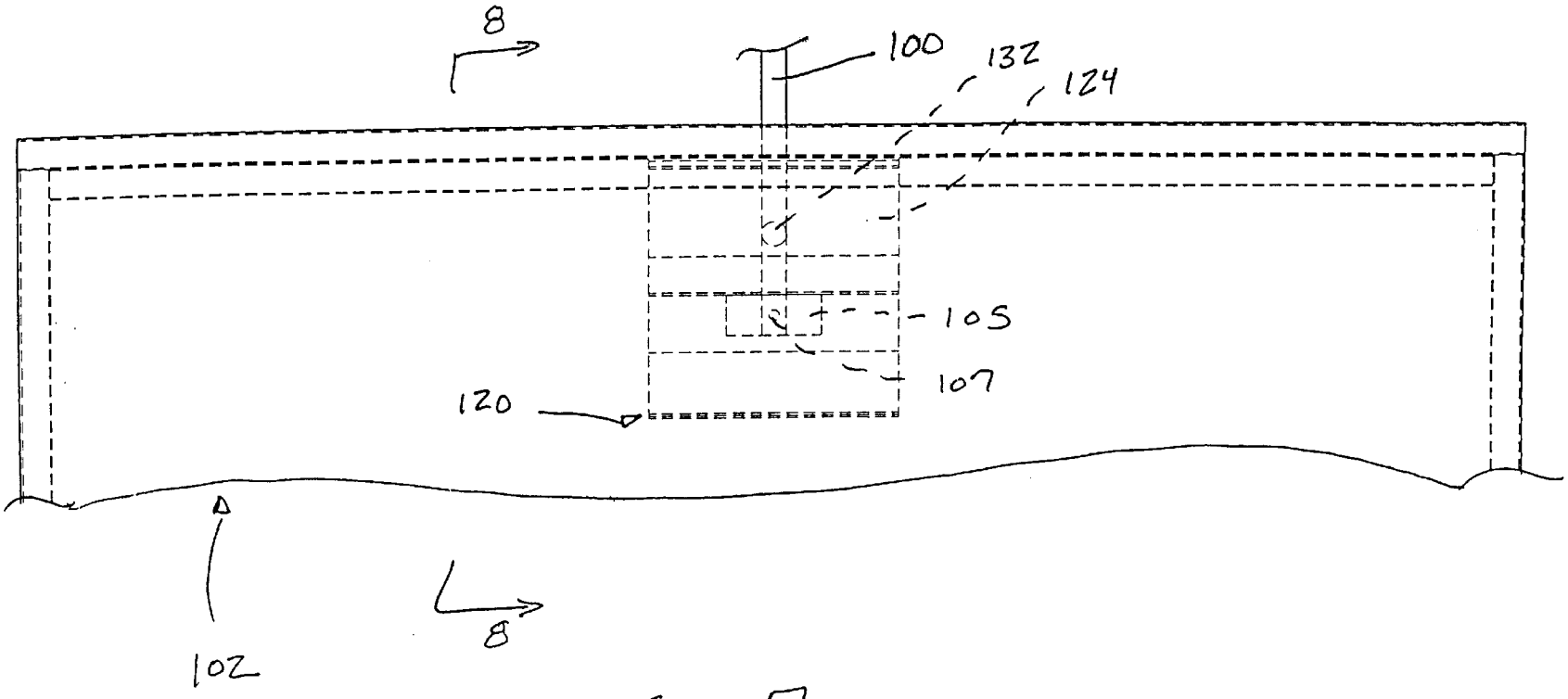
FIG. 7 is a diagrammatic, partial front view of the upper portion of another operable wall panel equipped with an alternate configuration of internal panel components, shown in dashed lines, that achieves a self-plumbing of the panel both within the plane of the panel width and perpendicular to the plane of the panel width.
Figure 8:
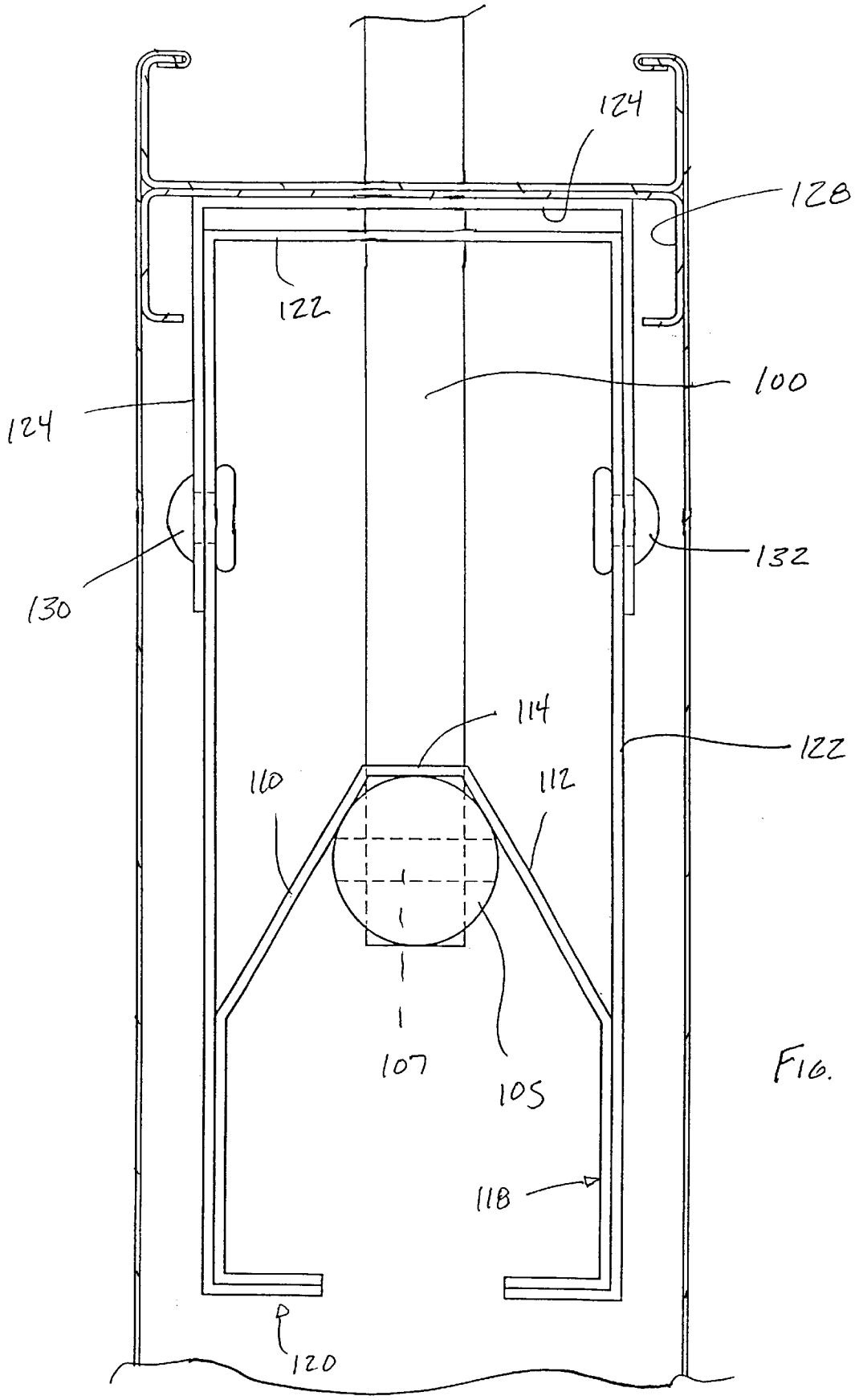
FIG. 8 is a cross-sectional view, conceptually taken along line 8—8 of FIG. 7.

Referring now to FIGS. 7 and 8, there is shown an alternate embodiment of a self-plumbing panel of the present invention that permits panel pivoting both within and perpendicular to the plane in which its panel width is aligned. This embodiment is shown employed in a panel suspended from a single, track mounted trolley, the depending trolley bolt of which is indicated at 100. Trolley bolt 100 is located over the mass center of the single panel, but may be differently located when the panel is hinged to another wall panel in an alternate wall panel system. Trolley bolt 100 extends through a slot-shaped opening in the upper steel frame assembly of panel 102. The structure of the panel frame and covering is not further described herein as it may be of the same general design as that disclosed with respect to the embodiment of FIGS. 3–6, or for that matter other conventional designs.

Trolley bolt 100 passes through slots in channels 124, 122 and 118 and the threaded lower end of bolt 100 is screwed into a tapped bore through cylindrical pivot block 105 and retained via roll pin 107. The rounded periphery of pivot block 105 serves as the point of sliding contact with the slanted segments 110, 112 and spanning horizontal segment 114 of cross beam inner channel 118. The ability of the cross beam to rotate around the pivot block permits pivoting motion of the wall panel relative to the trolley in a direction perpendicular to the plane of the panel width.

The steel cross beam, generally designated 120, is provided in this embodiment by securing inner channel 118 to a vertically elongated outer channel 122. In this embodiment, and as shown in FIG. 7, cross beam 120 is shown only extending about 15% of the panel width, but longer or shorter beam lengths may be employed.

Outer channel 122 nests within a C-shaped steel channel 124 that is secured, such as be welding, to the underside of frame member 128. A pair of rivets 130, 132 each extend through openings in steel channel 124 and outer channel 122 to permit steel channel 124 to pivot relative to outer channel 122, and more particularly cross beam 120, which achieves a pivoting of the panel frame and skin relative to the cross beam 120 within the plane of the panel width.

It will be appreciated that no springs or other resilient members which counter oscillations of the panel as it pivots within the plane of the panel width are shown being furnished between the cross beam and the panel frame. However, such dampening elements could be provided within the scope of the present invention.

Figure 9:
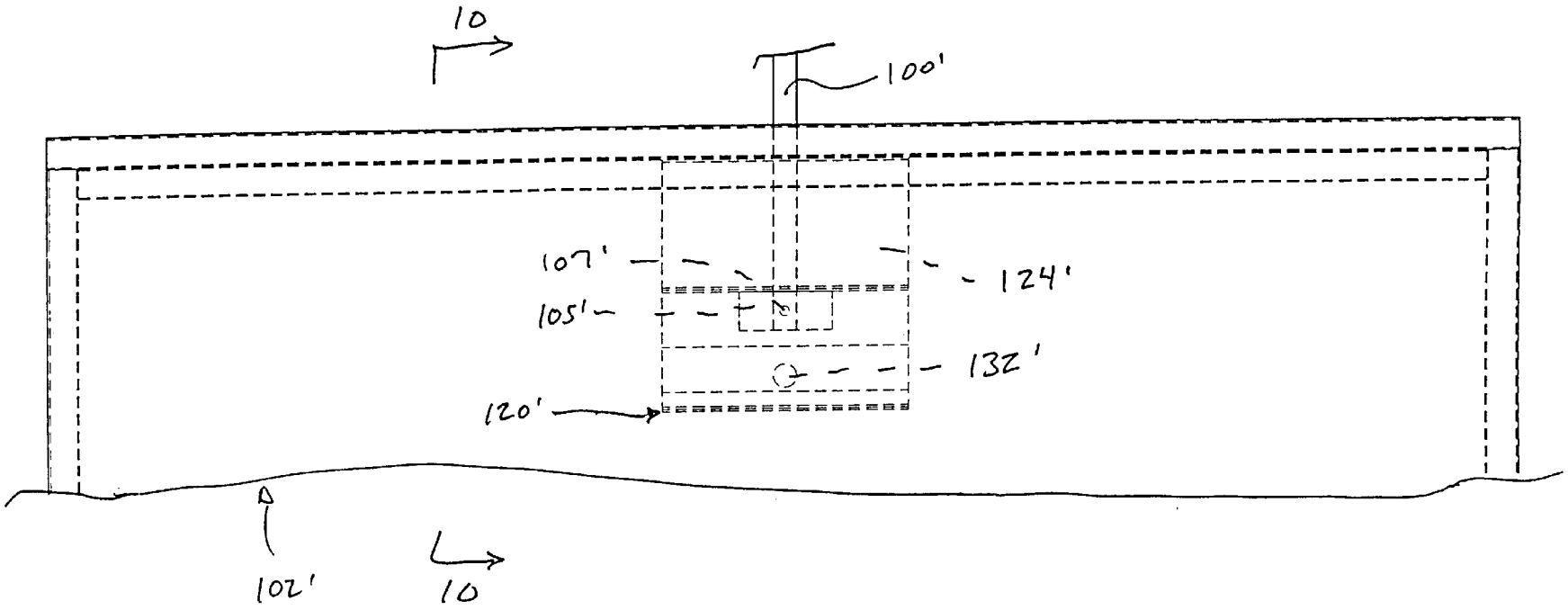
FIG. 9 is a diagrammatic, partial front view of the upper portion of another operable wall panel equipped with still another alternate configuration of internal panel components, shown in dashed lines, that achieves a self-plumbing of the panel both within the plane of the panel width and perpendicular to the plane of the panel width.
Figure 10:
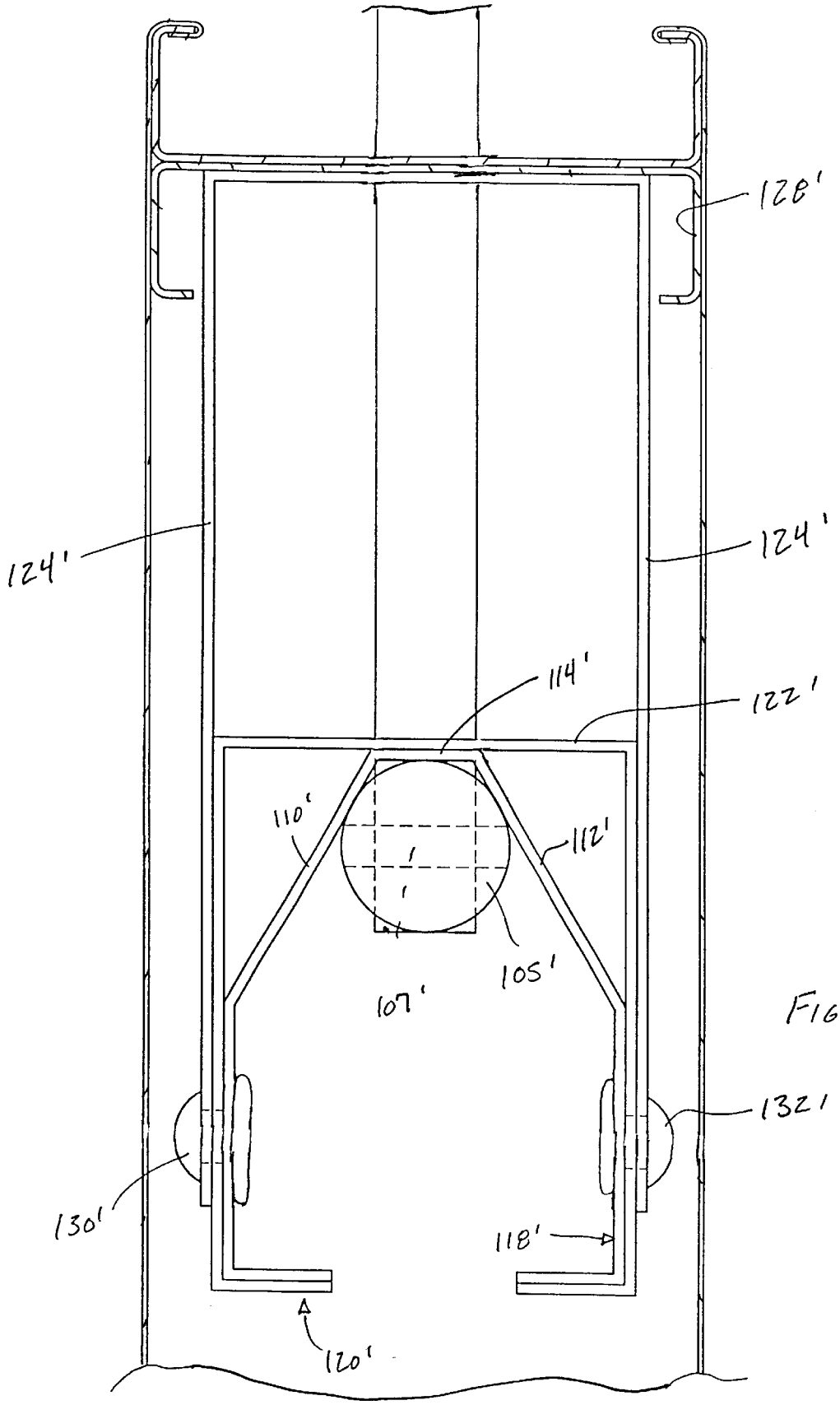
FIG. 10 is a cross-sectional view, conceptually taken along line 10—10 of FIG. 9.

Referring now to FIGS. 9 and 10, there is shown an alternate embodiment of a self-plumbing panel of the present invention that permits panel pivoting both within and perpendicular to the plane in which the panel width is aligned. Except as described below, this embodiment is identical to the embodiment of FIGS. 7 and 8, and corresponding parts are identified herein with a prime reference. In this embodiment, outer channel 122' has a lower height or profile, and steel channel 124' has vertically lengthened downwardly extending flanges that allow rivets 130' and 132' to pivotally connect the frame with the cross beam at an elevation below the pivot block 105'. Rivets 130' and 132' also extend through apertures provided in inner channel 118'.

Figure 11:
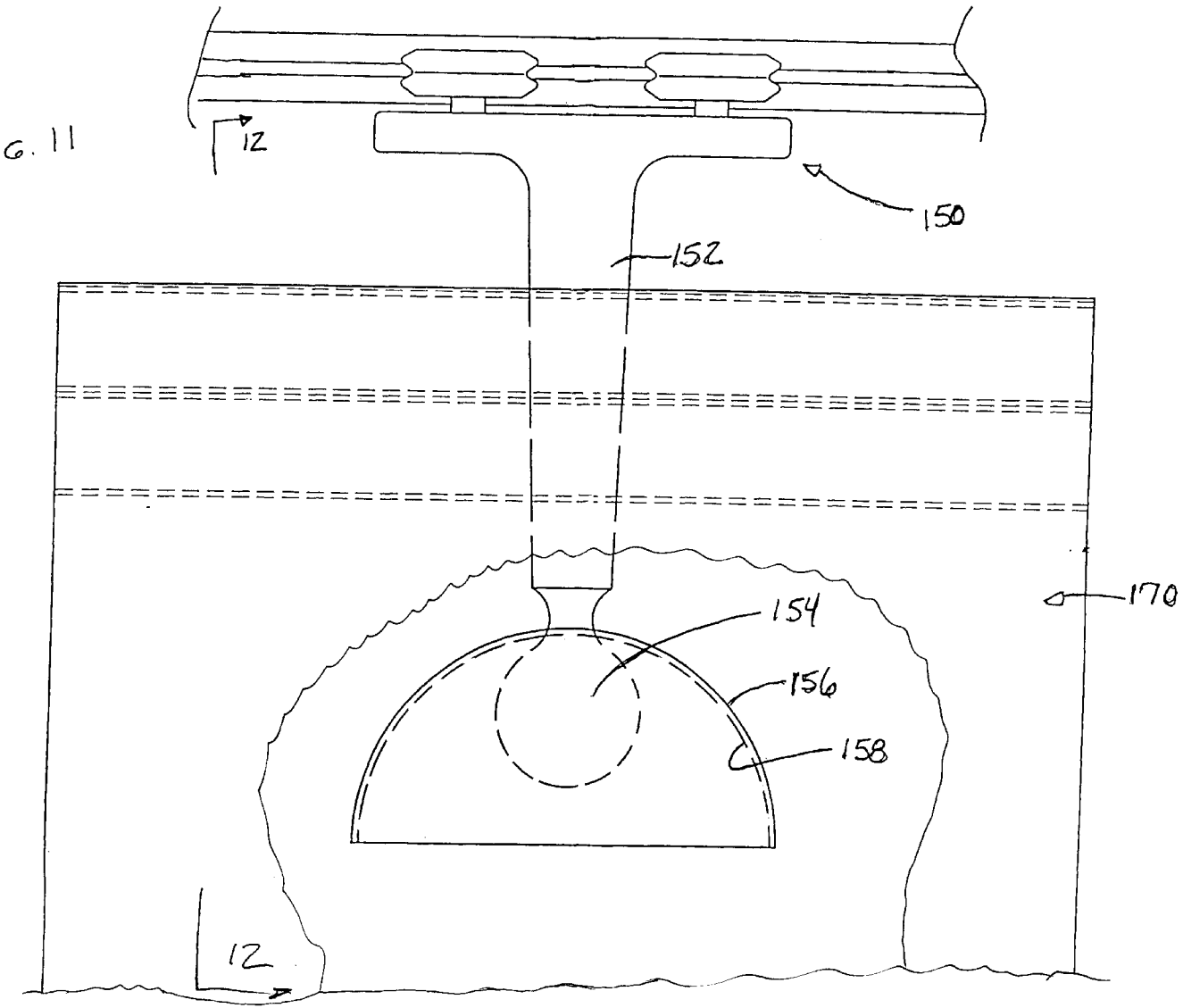
FIG. 11 is a diagrammatic, partial cross-sectional front view of the upper portion of another operable wall panel equipped with yet another alternate configuration of internal panel components that achieves a self-plumbing of the panel both within the plane of the panel width and perpendicular to the plane of the panel width.
Figure 12:
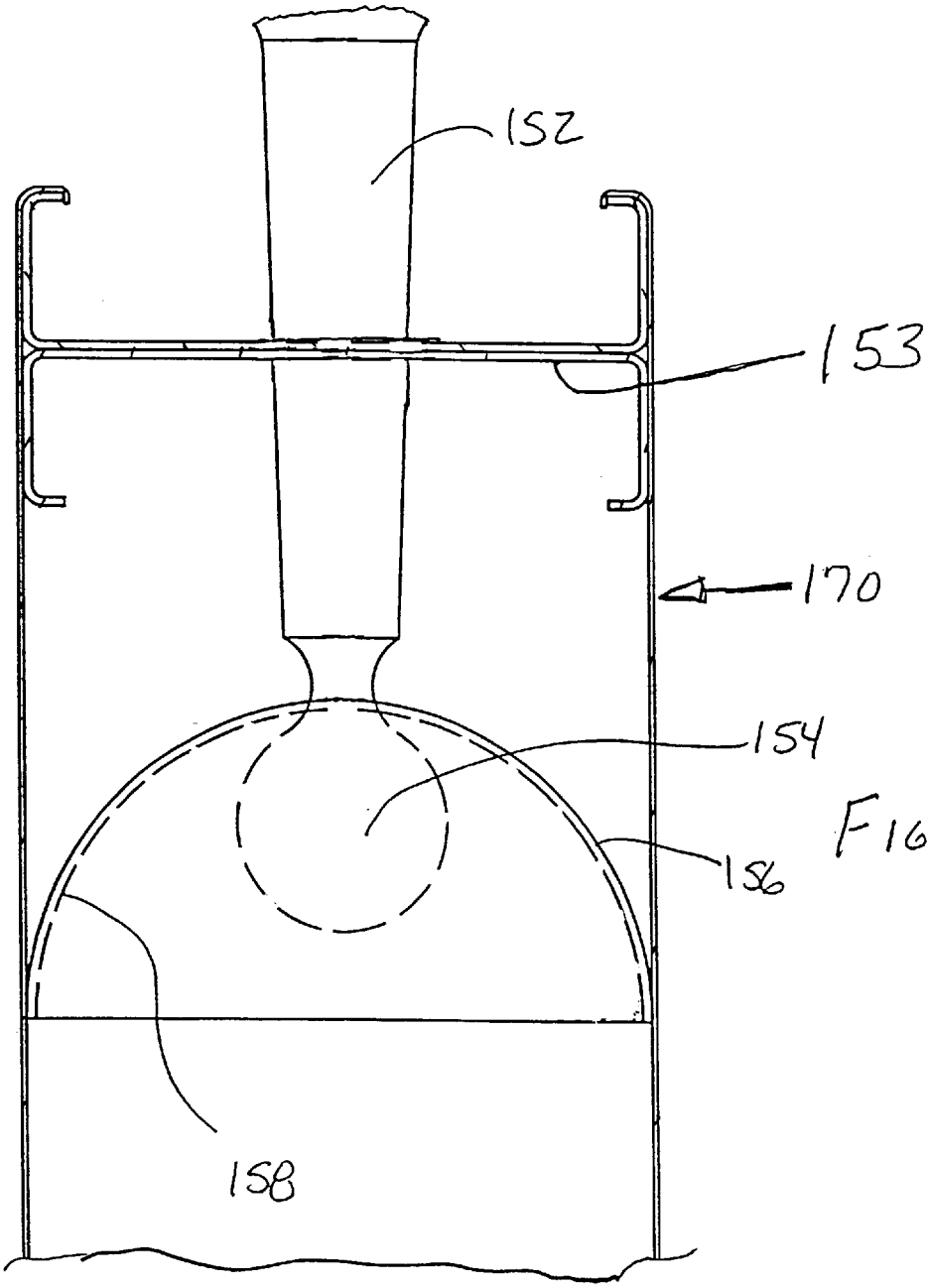
FIG. 12 is a cross-sectional view, conceptually taken along line 12—12 of FIG. 11.

Referring now to FIGS. 11 and 12, there is diagrammatically shown an alternate embodiment of a self-plumbing panel of the present invention that permits panel pivoting both within and perpendicular to the plane in which the panel width is aligned. This embodiment employs a linear motion track and trolley system, generally designated 150. The trolley pendant 152 extends through an opening through the upper steel frame assembly, generally designated 153, into the internal volume of a single or unhinged panel 156 over the center of mass of the panel. The distal end of pendant 152 includes a generally spherical head 154. Head 154 resides in a hollow, hemispherical pivot member 156 which is connected to the structural frame of panel 170 in a not shown manner. The inner surface 158 of pivot member 156 rides on the rounded periphery of pendant head 154, thereby allowing pivoting of panel 170 relative to trolley 150 in any and every direction.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A self-plumbing movable wall panel-system comprising:

a wall panel including a frame, said frame including an upper frame member;

at least one trolley movable along a track, said trolley including a depending member which passes through said upper frame member;

a pivot element connected to an end of said depending member, said pivot element having a flange portion received within a portion of said wall panel frame to allow relative motion therebetween about a pivot pin that extends through said flange portion and said upper frame member; and at least one biasing member extending between said upper frame member and said pivot element to resist said relative motion.

2. The system of claim 1 wherein said at least one trolley comprises first and second trolleys, and wherein said pivotal connection of said pivot element to said wall panel frame is positioned along a length of said pivot element between said depending member of said first trolley and said depending member of said second trolley.

3. The system of claim 2 wherein said at least one biasing member comprises a first spring proximate said depending member of said first trolley and a second spring proximate said depending member of said second trolley.

4. The system of claim 3 wherein said first spring comprises a compression spring through which axially extends a shaft of said depending member of said first trolley.

5. The system of claim 4 further comprising means for preloading said compression spring.

6. The system of claim 2 wherein said relative motion of said pivot element and said wall panel frame about the pivotal connection therebetween is in a first plane, wherein said depending member of each of said first and second trolleys comprises a pivot portion from which upwardly extends a shaft, said pivot portion in weight supporting engagement with said pivot element, wherein said pivot portion and said pivot element are complementarily structured and arranged to permit pivoting about said pivot portion of said pivot element and the connected wall panel frame in a direction generally perpendicular to said first plane.

7. The system of claim 6 wherein each said pivot portion comprises an upper surface in engagement with an underside of a channel member of said pivot element.

8. A self-plumbing movable wall panel system, comprising:

a wall panel including a frame;

at least one trolley movable along a track;

a pivot element connected to a depending member of said at least one trolley, said pivot element pivotally connected to said wall panel frame to allow relative motion therebetween; and at least one biasing member between said frame and said pivot element to resist said relative motion, and wherein said at least one trolley comprises first and second trolleys, and wherein said pivotal connection of said pivot element to said wall panel frame is positioned along a length of said pivot element between said depending member of said first trolley and said depending member of said second trolley, and wherein said relative motion of said pivot element and said wall panel frame about the pivotal connection therebetween is in a first plane, wherein said depending member of each of said first and second trolleys comprises a pivot portion from which upwardly extends a shaft, said pivot portion in weight supporting engagement with said pivot element wherein said pivot portion and said pivot element are complementarily structured and arranged to permit pivoting about said pivot portion of said pivot element and the connected wall panel frame in a direction generally perpendicular to said first plane, and wherein each said pivot portion comprises an upper surface in engagement with an underside of a channel member of said pivot element, and wherein each said pivot portion upper surface comprises a cylindrical surface having a length aligned with the length of said pivot element.

9. The system of claim 8 wherein each said pivot portion comprises a cylinder secured to a base of said shaft.

10. A self-plumbing movable wall panel system, comprising:

an overhead track;

at least one trolley movable along said track;

a wall panel; and means for suspending said wall panel from said at least one trolley such that said wall panel is free to pivot in an unrestricted manner within at least one plane about at least one axis, wherein said at least one axis is located within an interior volume of said panel, and wherein said at least one plane comprises a first plane aligned perpendicular to a room wall surface defining width of said panel and wherein pivoting in said first plane is unrestricted, and wherein said at least one plane comprises a second plane aligned with the room wall surface defining width of said panel.

11. The system of claim 10 wherein said suspending means comprises a trolley pendant with a first pivot member at a distal end, and a second pivot member attached to a frame of said wall panel, wherein one of said first pivot member and said second pivot member comprises a socket and the other of said first pivot member and said second pivot member comprises a rounded periphery and is adapted to engage an interior surface of said socket within a hollow of said socket and rotate in 360 degrees of direction relative to said socket.

12. The system of claim 11 wherein said second pivot member comprises said socket, and wherein said socket is generally hemispherical and opens downward.

13. The system of claim 10 wherein said at least one axis comprises a first axis and a second axis, wherein said wall panel pivots about said first axis when pivoting within said first plane, and wherein said wall panel pivots about said second axis when pivoting within said second plane.

14. The system of claim 13 wherein said suspending means comprises a pivot element within the interior volume of said wall panel, said pivot element including a pivot connection to a frame of said wall panel oriented to allow said wall panel to pivot relative to said pivot element within said second plane, whereby said pivot connection comprises said second point.

15. The system of claim 14 wherein said suspending means comprises a trolley pendant vertically extending through an opening in said pivot element, wherein a distal portion of said trolley pendant includes a pivot surface that engages an underside of said pivot element in weight supporting relationship, wherein said pivot surface and said pivot element underside are complementarily structured and arranged to permit pivoting about said pivot surface of said pivot element and the connected wall panel frame within said first plane, whereby said pivot surface comprises said first point.

16. A self-plumbing movable wall panel system, comprising:

an overhead track;

a wall panel including a frame;

a pivot element within an interior volume of said wall panel, said pivot element including a pivot connection to said wall panel frame to allow said panel to pivot within a first plane relative to said pivot element;

a first trolley and a second trolley each movable along said track, each of said first and second trolleys including a depending member vertically extending through openings in a top portion of said panel frame and said pivot element, wherein a distal portion of each of said depending members includes a pivot surface that engages an underside of said pivot element in weight supporting relationship, whereby movement of said first and second trolleys along said track moves said wall panel along said track between a wall-forming position and a storage position, wherein said pivot surface and said pivot element underside are complementarily structured and arranged to permit pivoting about said pivot surface of said pivot element and the connected wall panel frame in a direction generally perpendicular to said first plane; and first and second biasing members between said frame and said pivot element to resist pivoting within said first plane of said wall panel relative to said pivot element, wherein said first trolley depending member and said first biasing member are disposed on one side of said pivot connection, and wherein said second trolley depending member and said second biasing member are disposed on the opposite side of said pivot connection.

17. The system of claim 16 wherein a surface of said panel that extends a height and width of said panel forms a surface portion of a room wall when said panel is in the wall-forming position, and wherein said first plane is aligned generally parallel to said panel width.

18. The system of claim 17 wherein said pivot surfaces each comprise an upper surface of at least one cylindrical member attached to a shaft of its respective trolley depending member, and wherein said at least one cylindrical member has a length extending generally parallel to said panel width.

19. The system of claim 16 wherein said first biasing member comprises a coiled spring through which axially extends a shaft of said depending member of said first trolley.

* * * * *